US009457558B2

(12) United States Patent
Sente et al.

(10) Patent No.: US 9,457,558 B2
(45) Date of Patent: Oct. 4, 2016

(54) GRAVURE OFFSET PRINTING METHOD, GRAVURE OFFSET PRINTING DEVICE, AND GRAVURE PLATE

(71) Applicant: DIC Corporation, Tokyo (JP)

(72) Inventors: Yasuhiro Sente, Sakura (JP); Tomoko Okamoto, Sakura (JP); Yoshinori Katayama, Sakura (JP)

(73) Assignee: DIC Corporation, Tokyo (JP)

( * ) Notice: Subject to any disclaimer, the term of this patent is extended or adjusted under 35 U.S.C. 154(b) by 0 days.

(21) Appl. No.: 14/761,716

(22) PCT Filed: Jan. 16, 2014

(86) PCT No.: PCT/JP2014/050678
§ 371 (c)(1),
(2) Date: Jul. 17, 2015

(87) PCT Pub. No.: WO2014/112557
PCT Pub. Date: Jul. 24, 2014

(65) Prior Publication Data

US 2015/0352829 A1 Dec. 10, 2015

(30) Foreign Application Priority Data

Jan. 17, 2013 (JP) ..... 2013-006142

(51) Int. Cl.
*B41M 1/10* (2006.01)
*B41F 3/36* (2006.01)
*B41F 13/193* (2006.01)
*B41F 3/20* (2006.01)

(52) U.S. Cl.
CPC . *B41F 3/36* (2013.01); *B41F 3/20* (2013.01); *B41F 13/193* (2013.01); *B41M 1/10* (2013.01)

(58) Field of Classification Search
CPC ..... B41M 1/10; B41M 3/003; B41M 99/00; B41M 17/08
See application file for complete search history.

(56) References Cited

U.S. PATENT DOCUMENTS 6,701,839 B1 * 3/2004 Levy ..... B41F 9/00 101/153
2004/0211329 A1 * 10/2004 Funahata ..... B41M 1/00 101/463.1

(Continued)

FOREIGN PATENT DOCUMENTS

JP 08029616 A * 2/1996
JP 2011-240570 A 12/2011
JP 2012-020404 A 2/2012

OTHER PUBLICATIONS

International Search Report mailed Feb. 25, 2014, issued for PCT/JP2014/050678.

*Primary Examiner* — David Banh
(74) *Attorney, Agent, or Firm* — Locke Lord LLP

(57) ABSTRACT

Provided are a gravure offset printing method, a gravure offset printing apparatus, and a gravure plate that allow a fine wiring pattern to be accurately printed on the material to be printed. A gravure offset printing method executed by a gravure offset printing apparatus includes a step of filling a groove on a gravure plate with a printing paste, a step of offsetting the printing paste from the groove on the gravure plate to the blanket, and a step of transferring the printing paste from the blanket to a substrate. The groove on the gravure plate includes a region having a width of 100 to 700 μm in a direction perpendicular to a print direction. The region has a leading end tapered forward in the print direction and a trailing end split into a pair of branches by a notch tapered forward in the print direction.

3 Claims, 11 Drawing Sheets

(56) References Cited

U.S. PATENT DOCUMENTS

2004/0221755 A1* 11/2004 Hashimoto ..... H01G 4/308 101/153
2007/0007883 A1* 1/2007 Takeda ..... B41M 1/10 313/503
2008/0044744 A1* 2/2008 Yamazaki ..... H01L 27/1288 430/5
2012/0292307 A1* 11/2012 Kim ..... C03C 17/36 219/522
2015/0070611 A1* 3/2015 Shima ..... G02F 1/133753 349/42

* cited by examiner

FIG. 10

| WIDTH $w$ 600 [$\mu$m] | | a=270° | a=240° | a=210° | a=180° | a=150° | a=120° | a=80° |
|---|---|---|---|---|---|---|---|---|
| | LEADING END | a | a | a | a | a | a | a |
| | PINHOLE DEFECT | OCCURRED | OCCURRED | OCCURRED | OCCURRED | OCCURRED | NONE | NONE |
| | TRAILING END | b | b | b | b | b | b | b |
| | | b=80° | b=90° | b=120° | b=150° | b=180° | b=210° | b=240° |
| | PINHOLE DEFECT | NONE | OCCURRED | OCCURRED | OCCURRED | OCCURRED | OCCURRED | OCCURRED |
| | | | | | | | | b=270° |
| | | | | | | | | OCCURRED |

GRAVURE OFFSET PRINTING METHOD, GRAVURE OFFSET PRINTING DEVICE, AND GRAVURE PLATE

TECHNICAL FIELD

The present invention relates to gravure offset printing methods, gravure offset printing apparatuses, and gravure plates.

BACKGROUND ART

Wiring patterns such as conductive circuits and electrodes used in various electronic components such as touch panels are formed by various printing methods such as flexographic printing, screen printing, inkjet printing, gravure printing, and gravure offset printing, depending on, for example, the line width, thickness, and production rate of the patterns. Among these various printing methods, particular attention has been directed to gravure offset printing, for example, for the formation of fine wiring patterns with line widths of several tens of micrometers.

Gravure offset printing uses a gravure plate having formed thereon grooves corresponding to the desired print pattern and a blanket having a surface formed by silicone rubber (see, for example, PTL 1). A gravure offset printing process mainly includes a doctoring step of filling the grooves on the gravure plate with a printing paste, an off step of offsetting the printing paste from the grooves to the surface of the blanket, and a set step of transferring the printing paste from the blanket, for example, to a substrate. This printing method allows any print pattern to be selected depending on the pattern of the grooves and also provides a high rate of transfer of the printing paste from the blanket to the substrate and thus allows a fine wiring pattern to be accurately formed.

CITATION LIST

Patent Literature

PTL 1: Japanese Unexamined Patent Application Publication No. 2011-240570

PTL 2: Japanese Unexamined Patent Application Publication No. 2012-020404

SUMMARY OF INVENTION

Technical Problem

In the above gravure offset printing process, when a thin line pattern extending in the print direction is offset to the blanket in the off step, bubbles are less likely to escape from the printing paste with increasing line width of the thin line pattern. As a result, pinhole defects may occur in the fine wiring pattern printed on the printed material.

Accordingly, for example, the gravure offset printing method disclosed in PTL 2 uses a printing plate having elongated grooves extending in the print direction and tapered at the trailing ends thereof. Unfortunately, this known printing plate leaves bubbles in the printing paste, particularly at the leading ends of the elongated grooves. As a result, pinhole defects may occur in the fine wiring pattern printed on the printed material.

In view of the foregoing problem, an object of the present invention is to provide a gravure offset printing method, a gravure offset printing apparatus, and a gravure plate that allow a fine wiring pattern to be accurately printed on the material to be printed while preventing pinhole defects in the fine wiring pattern.

Solution to Problem

To achieve the foregoing object, a gravure offset printing method according to the present invention is a gravure offset printing method for printing a fine wiring pattern on a material to be printed. This method includes a filling step of filling a groove defined on a gravure plate such that the groove corresponds to the fine wiring pattern with a printing paste; after the filling step, an offset step of bringing a blanket into contact with the gravure plate to offset the printing paste from the groove to the blanket; and after the offset step, a transfer step of bringing the blanket into contact with the material to be printed to transfer the printing paste from the blanket to the material to be printed. The groove includes a region having a width of 100 to 700 μm in a direction perpendicular to a print direction. The region has in the print direction a leading end tapered forward in the print direction and a trailing end split into a pair of branches by a notch tapered forward in the print direction, each branch being tapered backward in the print direction.

This gravure offset printing method uses a gravure plate having defined thereon a groove including a region having a width of 100 to 700 μm in a direction perpendicular to the print direction. The leading end (the end where printing starts) of the region in the print direction is tapered (decreases in width gradually) forward in the print direction. Thus, when the blanket is brought into contact with the gravure plate in the offset step, the blanket can readily expel bubbles present on the gravure plate at the leading end of the region. This prevents pinhole defects in the print line formed on the blanket. In addition, the trailing end (the end where printing ends) of the region in the print direction is split into a pair of branches by a notch tapered forward in the print direction, each branch being tapered backward in the print direction. Thus, when the blanket is brought into contact with the gravure plate in the offset step, the blanket can readily expel bubbles present on the gravure plate at the trailing end of the region. This prevents pinhole defects in the print line formed on the blanket. Thus, this gravure offset printing method allows a fine wiring pattern to be accurately printed on the material to be printed while preventing pinhole defects in the fine wiring pattern.

Preferably, the relational expression $a<0.23w+13.6$ is satisfied, where a (°) is the angle between two sides defining the shape of the leading end, and w (μm) is the width of the region. In this case, the blanket can more readily expel bubbles present on the gravure plate at the leading end of the region. This more reliably prevents pinhole defects in a fine wiring pattern.

Preferably, the relational expression $b<90$ is satisfied, where b (°) is the angle between two sides defining the shape of the notch. In this case, the blanket can more readily expel bubbles present on the gravure plate at the trailing end of the region. This more reliably prevents pinhole defects in a fine wiring pattern.

A gravure offset printing apparatus according to the present invention is a gravure offset printing apparatus for printing a fine wiring pattern on a material to be printed. This apparatus includes a blanket configured to be brought into contact with a gravure plate having a groove defined thereon such that the groove corresponds to the fine wiring pattern to offset a printing paste from the groove to the blanket and to be brought into contact with the material to be printed to transfer the printing paste from the blanket to the material to be printed; a first moving mechanism configured to move the gravure plate while maintaining the blanket in contact with the gravure plate; and a second moving mechanism configured to move the material to be printed while maintaining the blanket in contact with the material to be printed. The groove includes a region having a width of 100 to 700 μm in a direction perpendicular to a print direction. The region has in the print direction a leading end tapered forward in the print direction and a trailing end split into a pair of branches by a notch tapered forward in the print direction, each branch being tapered backward in the print direction.

As with the gravure offset printing method described above, this gravure offset printing apparatus allows a fine wiring pattern to be accurately printed on the material to be printed while preventing pinhole defects in the fine wiring pattern.

A gravure plate according to the present invention is a gravure plate for use in a gravure offset printing apparatus for printing a fine wiring pattern on a material to be printed. This gravure plate has a groove defined thereon such that the groove corresponds to the fine wiring pattern. The groove includes a region having a width of 100 to 700 μm in a direction perpendicular to a print direction. The region has in the print direction a leading end tapered forward in the print direction and a trailing end split into a pair of branches by a notch tapered forward in the print direction, each branch being tapered backward in the print direction.

As with the gravure offset printing method described above, this gravure plate allows a fine wiring pattern to be accurately printed on the material to be printed while preventing pinhole defects in the fine wiring pattern.

Advantageous Effects of Invention

The present invention allows a fine wiring pattern to be accurately printed on the material to be printed while preventing pinhole defects in the fine wiring pattern.

BRIEF DESCRIPTION OF DRAWINGS

FIG. 10 shows the relationship between the shapes of the leading and trailing ends of electrode region portions having a width of 600 μm and the occurrence of pinhole defects.

DESCRIPTION OF EMBODIMENTS

Figure 1:
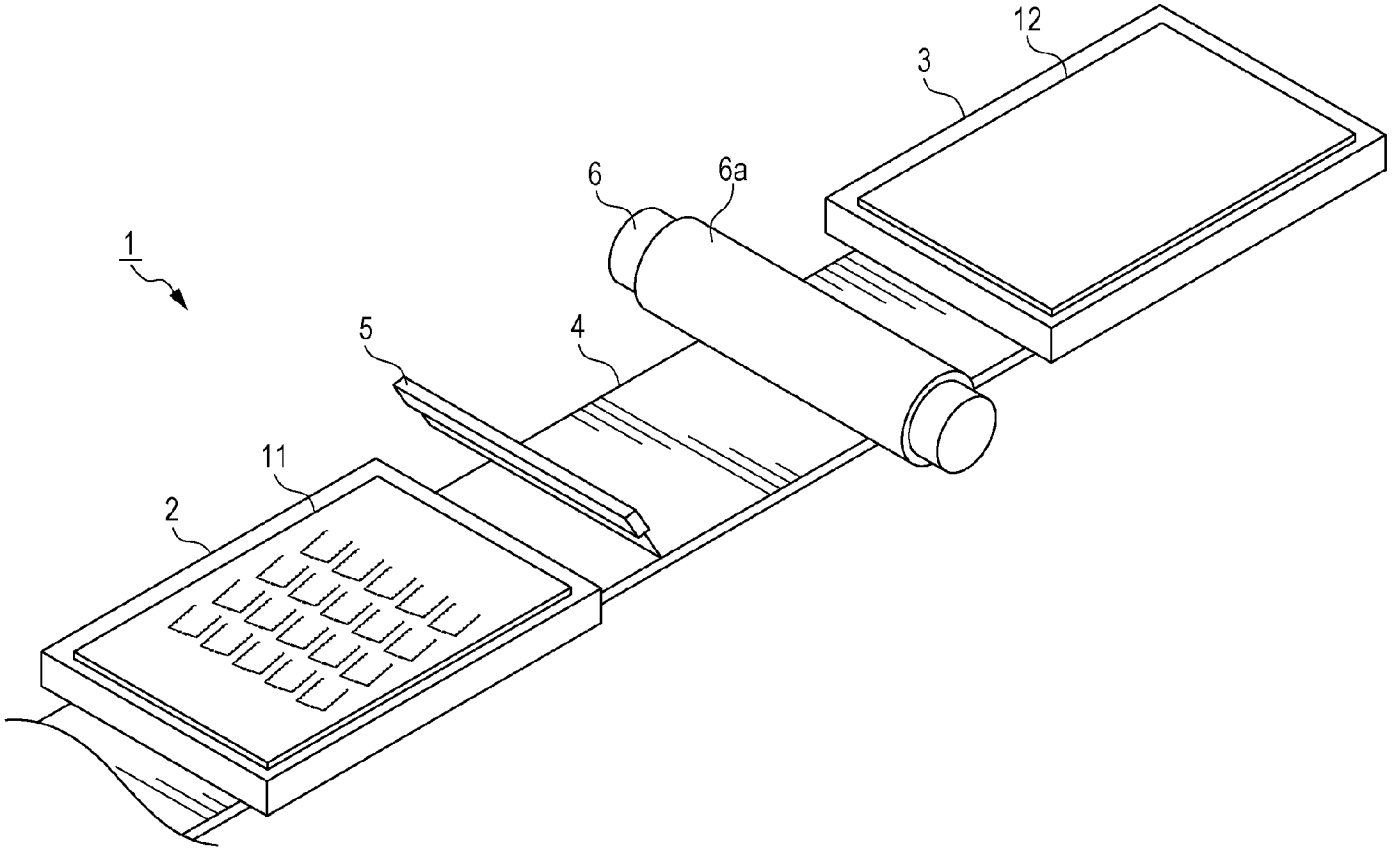
FIG. 1 is a perspective view showing a main structure of an embodiment of a gravure offset printing apparatus according to the present invention.

Preferred embodiments of the present invention will now be described in detail with reference to the drawings. In the drawings, the same or corresponding elements are indicated by the same reference signs to avoid a redundant description.

As shown in FIG. 1, a gravure offset printing apparatus 1 includes a first stage (first moving mechanism) 2 on which a gravure plate 11 is placed, a second stage (second moving mechanism) 3 on which a substrate 12 serving as a material to be printed is placed, a transport unit (first moving mechanism and second moving mechanism) 4 that linearly moves the first stage 2 and the second stage 3 back and forth in a predetermined direction, a doctor blade 5 arranged to be pressed against the gravure plate 11, and a blanket 6 arranged to be pressed against the gravure plate 11 and the substrate 12.

The gravure offset printing apparatus 1 is configured as an apparatus for printing a fine wiring pattern on the substrate 12, for example, a transparent conductive film for use in touch panels, by gravure offset printing. The fine wiring pattern formed on the substrate 12 may be, for example, a bezel pattern 13 including electrode portions and wiring portions and formed along the edges of the display area of a touch panel.

Figure 2:
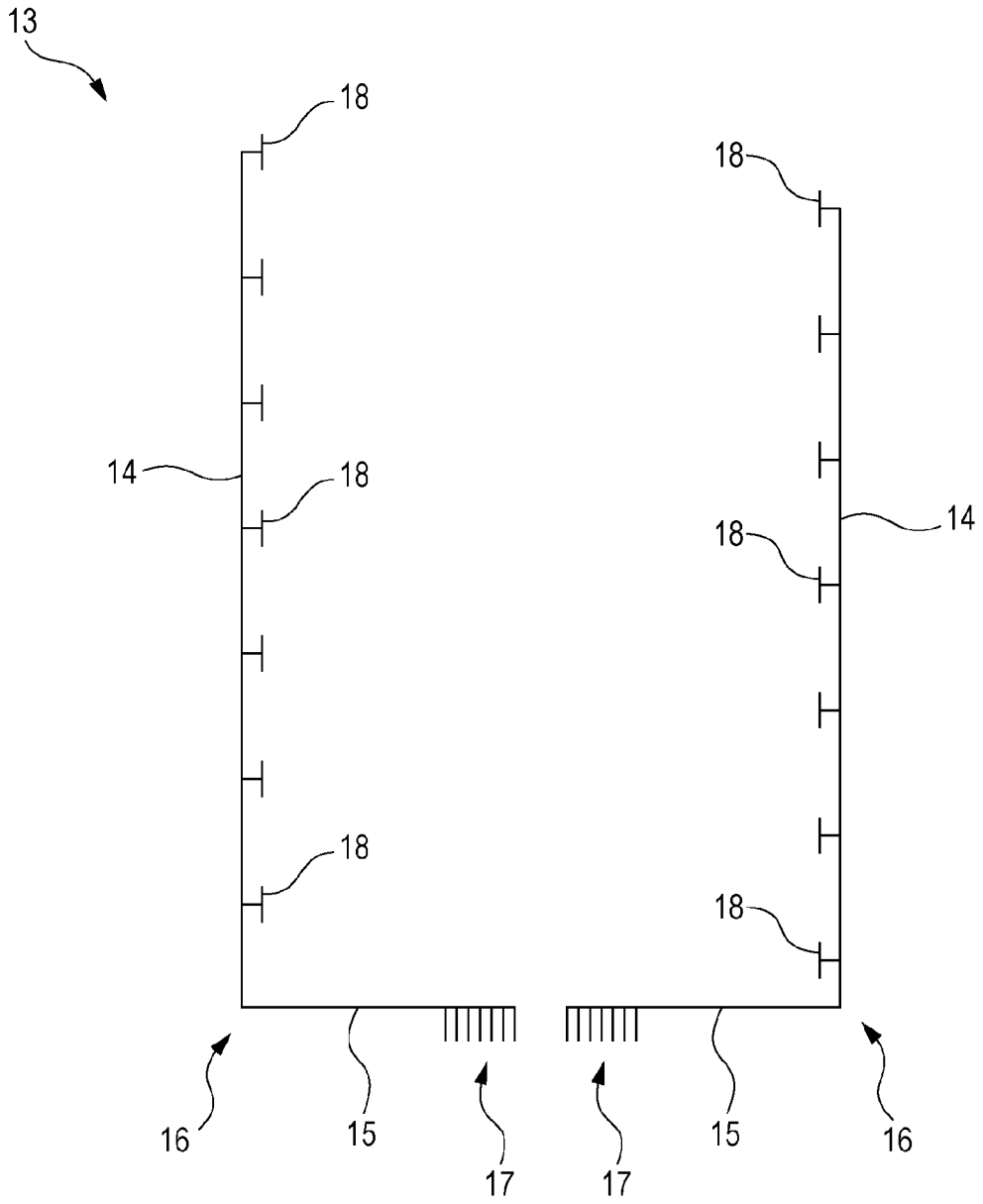
FIG. 2 is a plan view showing an example fine wiring pattern printed by the gravure offset printing apparatus shown in FIG. 1.

The bezel pattern 13 is a pattern of thin lines connected to transparent electrodes. For example, as shown in FIG. 2, the bezel pattern 13 includes a pair of substantially L-shaped wiring portions 16 and 16, each including a first thin line pattern 14 extending in a predetermined direction and a second thin line pattern 15 extending from one end of the first thin line pattern 14 in a direction substantially perpendicular to the first thin line pattern 14. An electrode pattern 17 is formed by a plurality of thin lines extending from one end of the second thin line pattern 15 in a direction opposite to the first thin line pattern 14. The pair of substantially L-shaped wiring portions 16 and 16 are arranged in such a way that the electrode patterns 17 and 17 face each other at a predetermined distance and that the first thin line patterns 14 and 14 are substantially parallel to each other. The first thin line patterns 14 and the second thin line patterns 15 have a line width of, for example, 10 to 100 μm. The electrode patterns 17 are formed, for example, in substantially rectangular regions with a length of about 2,000 μm and a width of about 200 μm.

The bezel pattern 13 further includes electrode patterns 18 for contact with other conductors such as output electrodes. The electrode patterns 18 are arranged inside and along each of the pair of first thin line patterns 14 and are electrically connected to the first thin line patterns 14. The electrode patterns 18 are elongated regions extending in the same direction as the first thin line patterns 14 and have, for example, a length of 1,000 to 5,000 μm and a width of 100 to 700 μm. Thus, the electrode patterns 18 have a larger line width than the first thin line patterns 14.

A printing paste P (see FIG. 4) used to form a fine wiring pattern may be prepared, for example, by agitating a mixture of ingredients such as a conductive powder, a resin, and a solvent with equipment such as a three-roll mill. Examples of conductive powders include powders of various metals such as Ag, Au, Pt, Cu, and Al. Either elemental metals or alloys may be used. The conductive powder may be composed of particles coated with different metals. The conductive powder may have various particle shapes such as spherical, dendritic, and flaky shapes.

Examples of resins include various resins such as thermosetting resins, ultraviolet-curable resins, and thermoplastic resins. Examples of thermosetting resins include melamine resins, epoxy resins, phenolic resins, polyimide resins, and acrylic resins. Examples of ultraviolet-curable resins include acrylic resins with (meth)acryloyl groups, epoxy resins, polyester resins, and mixtures thereof with monomers. Examples of thermoplastic resins include polyester resins, polyvinyl butyral resins, cellulose resins, and acrylic resins. These resins may be used alone or in a mixture of two or more.

The solvent preferably contains a high-boiling-point solvent having a boiling point of, for example, 240° C. or higher to prevent the printing paste P from drying during a printing process. Examples of high-boiling-point solvents include diamylbenzene, triamylbenzene, diethylene glycol, diethylene glycol monobutyl ether acetate, diethylene glycol dibutyl ether, diethylene glycol monoacetate, triethylene glycol, triethylene glycol monomethyl ether, triethylene glycol monoethyl ether, triethylene glycol monobutyl ether, tetraethylene glycol, and tetraethylene glycol monobutyl ether.

Figure 3:
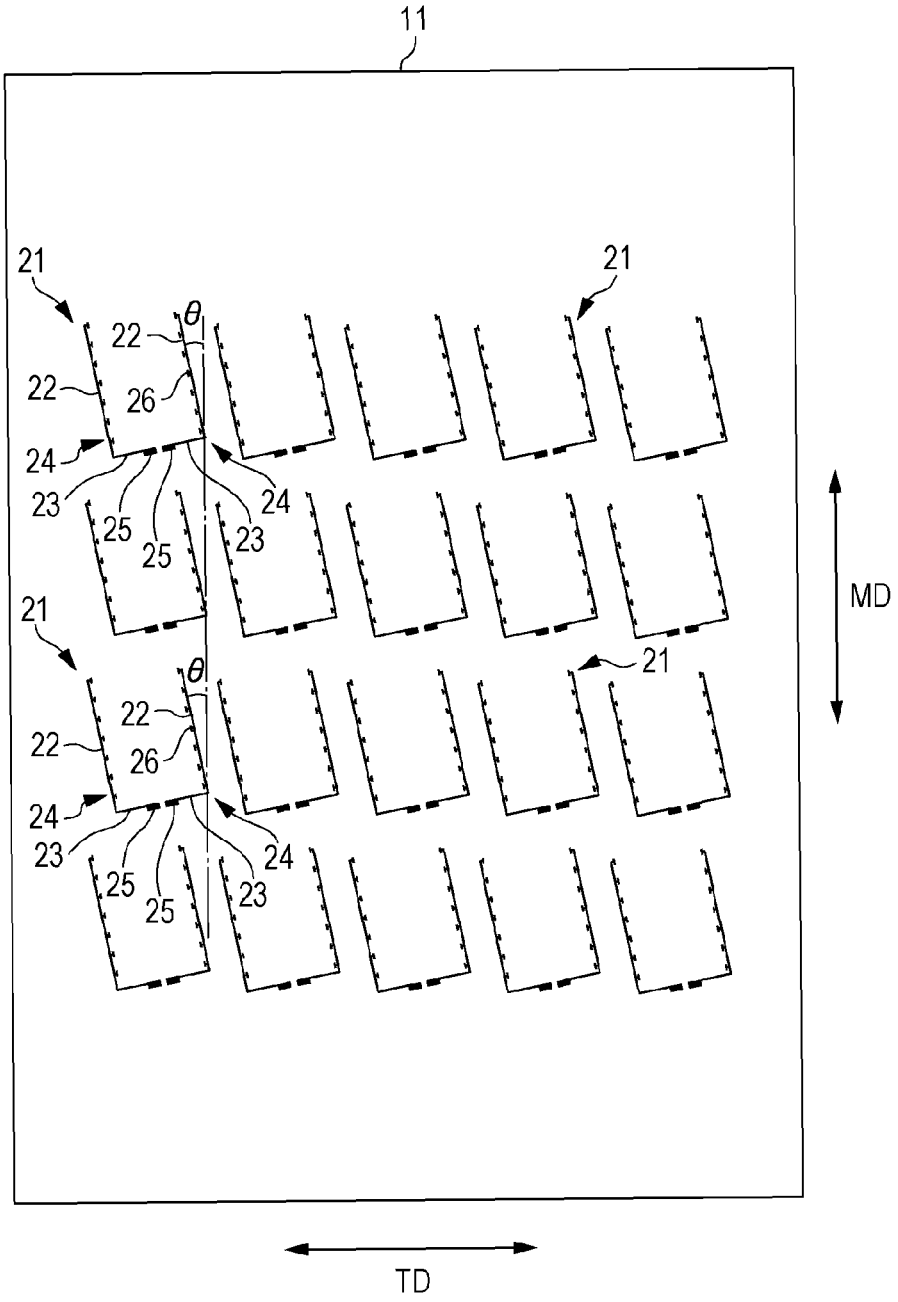
FIG. 3 is a plan view showing an example gravure plate used by the gravure offset printing apparatus shown in FIG. 1.

The gravure plate 11 is formed, for example, as a flat plate using a material such as soda-lime glass or non-alkali glass. As shown in FIG. 3, this gravure plate 11 has grooves 21 for printing that correspond to the bezel pattern 13. The grooves 21 are formed by a technique such as etching and are arranged, for example, in a matrix on the gravure plate 11. Each groove 21 includes a pair of substantially L-shaped thin line portions 24 and 24, each including a first thin line portion 22 corresponding to the first thin line pattern 14 and a second thin line portion 23 corresponding to the second thin line pattern 15. An electrode region portion 25 corresponding to the electrode pattern 17 is formed at one end of the second thin line portion 23. The pair of substantially L-shaped thin line portions 24 and 24 are arranged in such a way that the electrode region portions 25 and 25 face each other at a predetermined distance and that the first thin line portions 22 and 22 are substantially parallel to each other. Each groove 21 further includes electrode region portions 26 corresponding to the electrode patterns 18. The grooves 21 have a depth of 5 to 20 μm.

The line width of the first thin line portions 22 and the second thin line portions 23 substantially matches the line width of the first thin line patterns 14 and the second thin line patterns 15, for example, 10 to 100 μm. The electrode region portions 25 are formed in regions substantially matching the regions where the electrode patterns 17 are formed, for example, in substantially rectangular regions with a length of about 2,000 μm and a width of about 200 μm. The width of the electrode region portions 26 substantially matches the width of the electrode patterns 18, for example, 100 to 700 μm. The length of the electrode region portions 26 substantially matches the length of the electrode patterns 18, for example, 1,000 to 5,000 μm. The above grooves 21 are formed in such a way that the first thin line portions 22 extend in the transport direction of the transport unit 4 (hereinafter referred to as "machine direction (MD)") and that the second thin line portions 23 extend in a direction perpendicular to the transport direction of the transport unit 4 (hereinafter referred to as "transverse direction (TD)"). The grooves 21 are inclined at an acute angle of inclination θ with respect to the MD.

As shown in FIG. 1, the doctor blade 5 is disposed above the transport path of the first stage 2 in such a way that the blade edge thereof is pressed against the surface of the gravure plate 11 when the first stage 2 passes under the doctor blade 5. Thus, the doctor blade 5 scrapes the printing paste P off the entire surface of the gravure plate 11 to fill the grooves 21 on the gravure plate 11 with the printing paste P.

The blanket 6 is, for example, a cylinder wrapped with a material such as rubber and is rotatable about the axis thereof. The blanket 6 is disposed above the transport unit 4 and is driven by drive means such as a linear servo motor between an advanced position where the blanket 6 can be pressed against the gravure plate 11 on the first stage 2 or against the substrate 12 on the second stage 3 and a retracted position where the blanket 6 is separated from the gravure plate 11 or the substrate 12.

The rubber forming the surface 6*a* of the blanket 6 is preferably selected in view of the ease with which the printing paste P can be released and offset. For example, silicone rubber may be used. This rubber provides suitable hardness for the surface 6*a* of the blanket 6 and thus optimizes the deformation of the surface 6*a* of the blanket 6 when the printing paste P is offset from the gravure plate 11 to the blanket 6 and when the printing paste P is transferred from the blanket 6 to the substrate 12.

Thus, the blanket 6 is configured to be brought into contact with the gravure plate 11 to offset the printing paste P from the grooves 21 on the gravure plate 11 to the blanket 6 and to be brought into contact with the substrate 12 to transfer the printing paste P from the blanket 6 to the substrate 12. The transport unit 4 and the first stage 2 are configured to move the gravure plate 11 in the MD while maintaining the blanket 6 in contact with the gravure plate 11. The transport unit 4 and the second stage 3 are configured to move the substrate 12 in the MD while maintaining the blanket 6 in contact with the substrate 12.

A gravure offset printing method executed by the above gravure offset printing apparatus 1 will now be described.

A printing process executed by the gravure offset printing apparatus 1 to print a fine wiring pattern on the substrate 12 mainly includes a doctoring step (filling step) of filling the grooves 21 on the gravure plate 11 with the printing paste P; after the doctoring step, an off step (offset step) of bringing the blanket 6 into contact with the gravure plate 11 to offset the printing paste P from the grooves 21 to the blanket 6; and after the off step, a set step (transfer step) of bringing the blanket 6 into contact with the substrate 12 to transfer the printing paste P from the blanket 6 to the substrate 12. When the printing process starts, the gravure plate 11 is placed on the first stage 2, and the substrate 12 is placed in registration on the second stage 3, for example, using a camera. The printing paste P is applied over the entire surface of the gravure plate 11 in advance.

Figure 4:
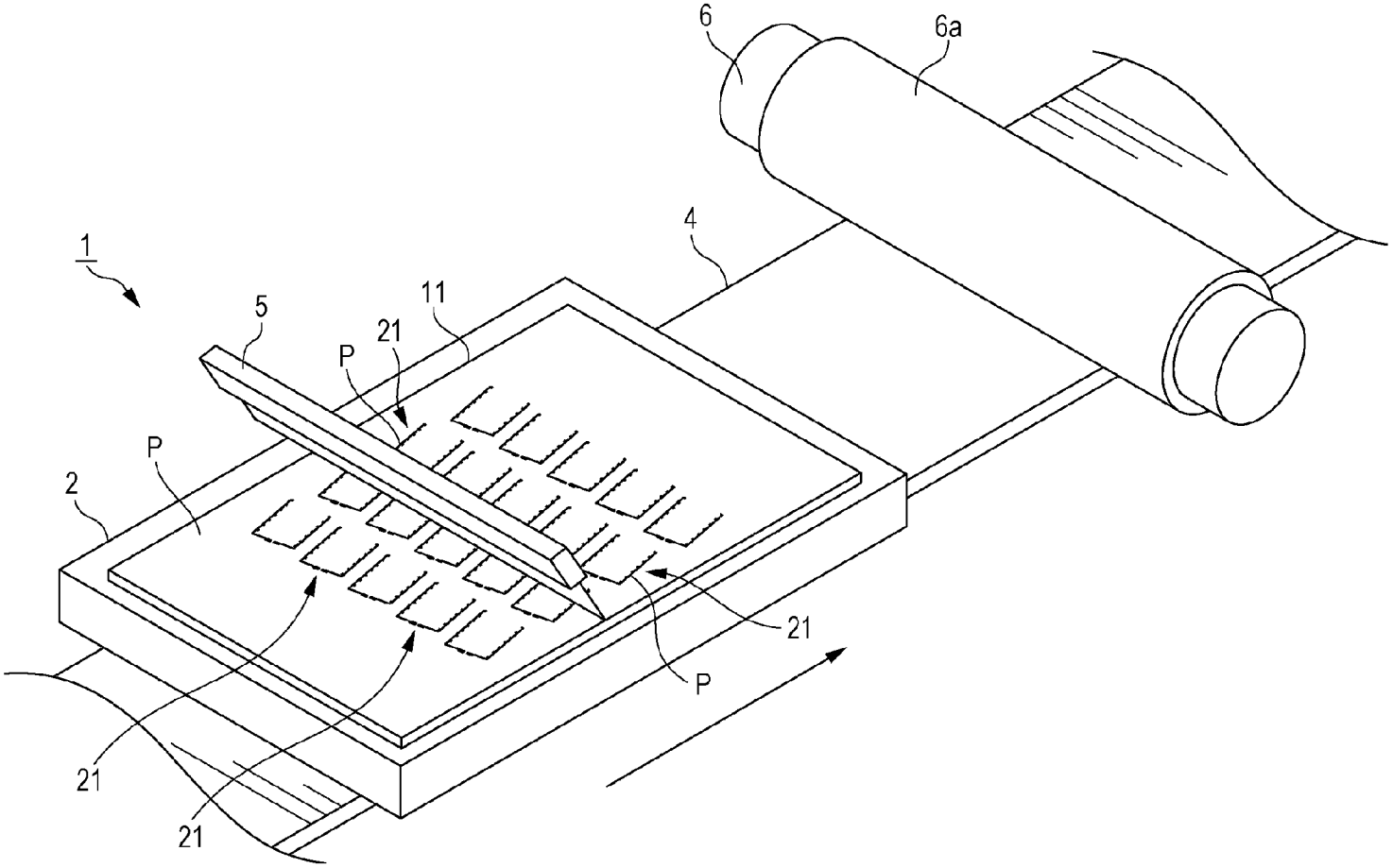
FIG. 4 is a perspective view showing a doctoring step of a gravure offset printing method executed by the gravure offset printing apparatus shown in FIG. 1.

In the doctoring step, as shown in FIG. 4, the first stage 2 carrying the gravure plate 11 is transported toward the blanket 6 at a predetermined speed and passes under the doctor blade 5. Thus, the doctor blade 5 is pressed against the surface of the gravure plate 11 to scrape the printing paste P off the surface of the gravure plate 11 at the blade edge thereof. After the first stage 2 leaves the doctor blade 5, the grooves 21 on the gravure plate 11 are filled with the printing paste P.

Figure 5:
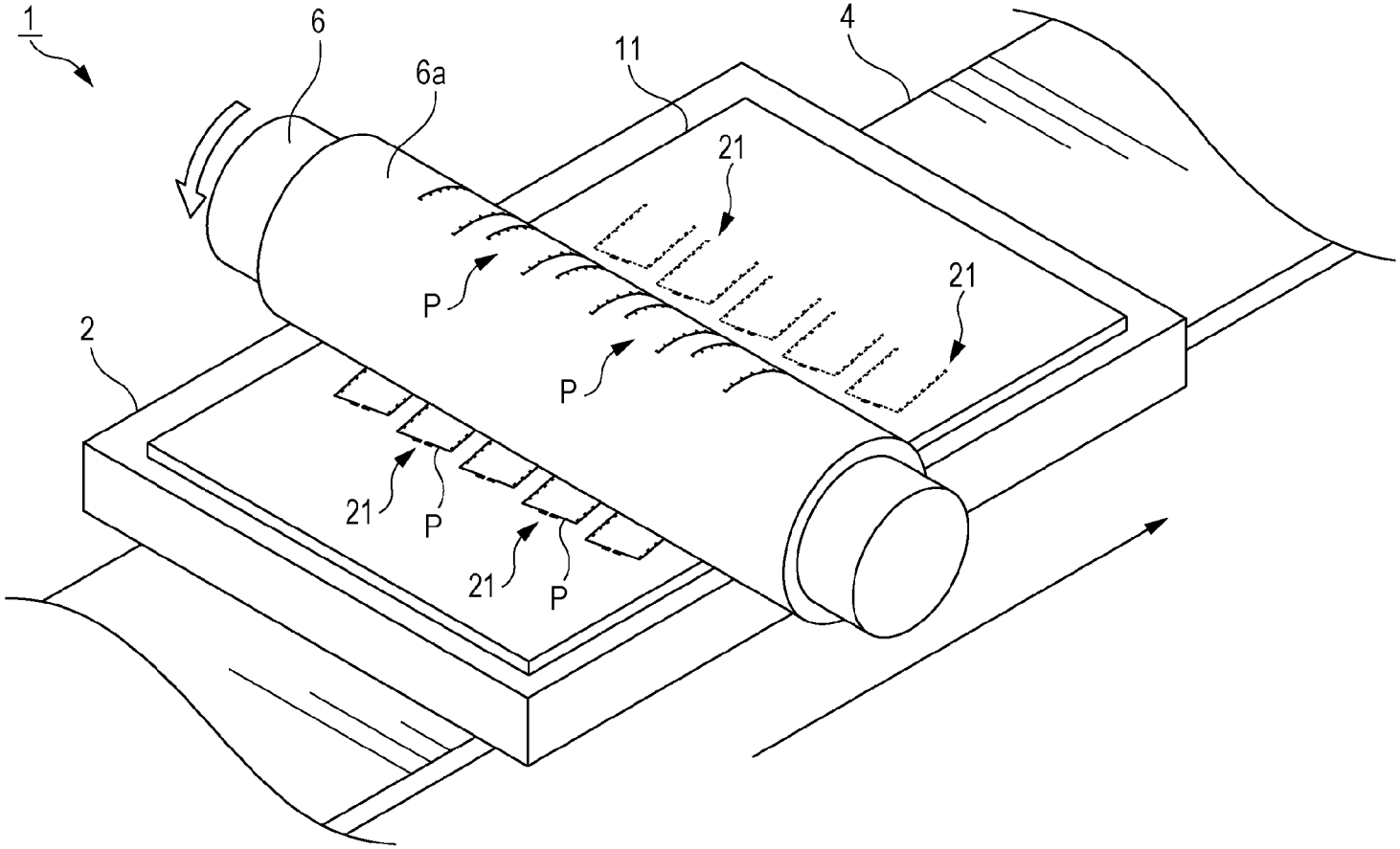
FIG. 5 is a perspective view showing an off step following the step in FIG. 4.

In the off step, the blanket 6 is advanced to the pressing position. As shown in FIG. 5, the first stage 2 passes under the blanket 6. Thus, the printing paste P is offset from the grooves 21 on the gravure plate 11 to the surface 6*a* of the blanket 6. The printing paste P released from the grooves 21 forms the bezel pattern 13 on the surface 6*a* of the blanket 6. Preferably, when the printing paste P is offset to the surface 6*a* of the blanket 6 in the off step, the solvent in the printing paste P is sufficiently absorbed into the surface 6*a* of the blanket 6. This allows the printing paste P to be accurately transferred from the blanket 6 to the substrate 12 in the subsequent set step.

Figure 6:
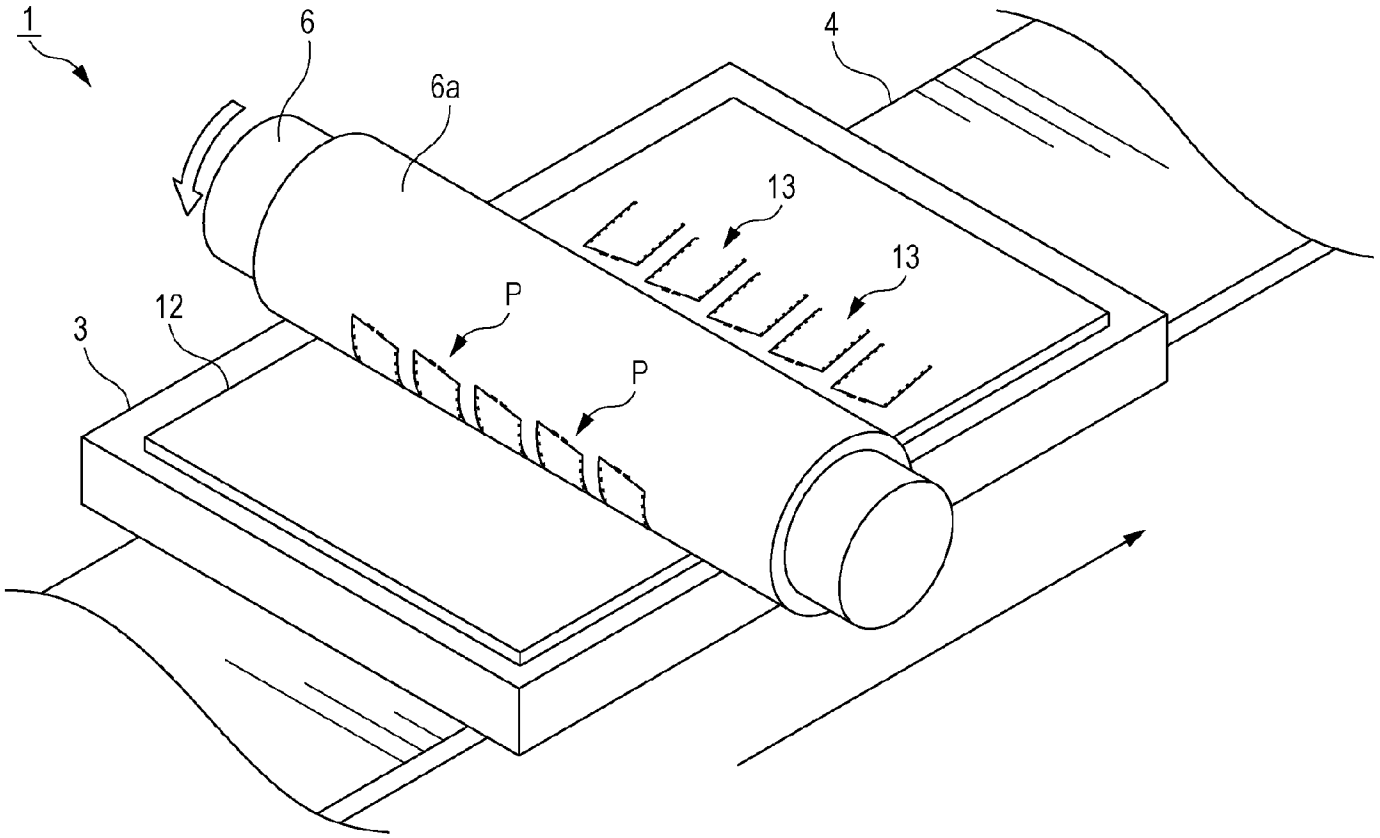
FIG. 6 is a perspective view showing a set step following the step in FIG. 5.

In the set step, the blanket 6 is moved to the retracted position. The first stage 2 is returned to the initial position, and the second stage 3 is transported past the blanket 6 toward the doctor blade 5. The blanket 6 is then advanced again to the pressing position. As shown in FIG. 6, the second stage 3 passes under the blanket 6. Thus, the bezel pattern 13 is transferred from the surface 6*a* of the blanket 6 to the substrate 12. The printing process is completed.

If the above printing process is repeated, the placement of the substrate 12 on the second stage 3, the application of the printing paste P to the surface 6*a* of the gravure plate 11, the doctoring step, the off step, and the set step are sequentially executed. While the printing process is repeated, the position of the gravure plate 11 is not changed, and the angle of inclination θ (see FIG. 3) of the grooves 21 with respect to the print direction (MD) is maintained.

Figure 7:
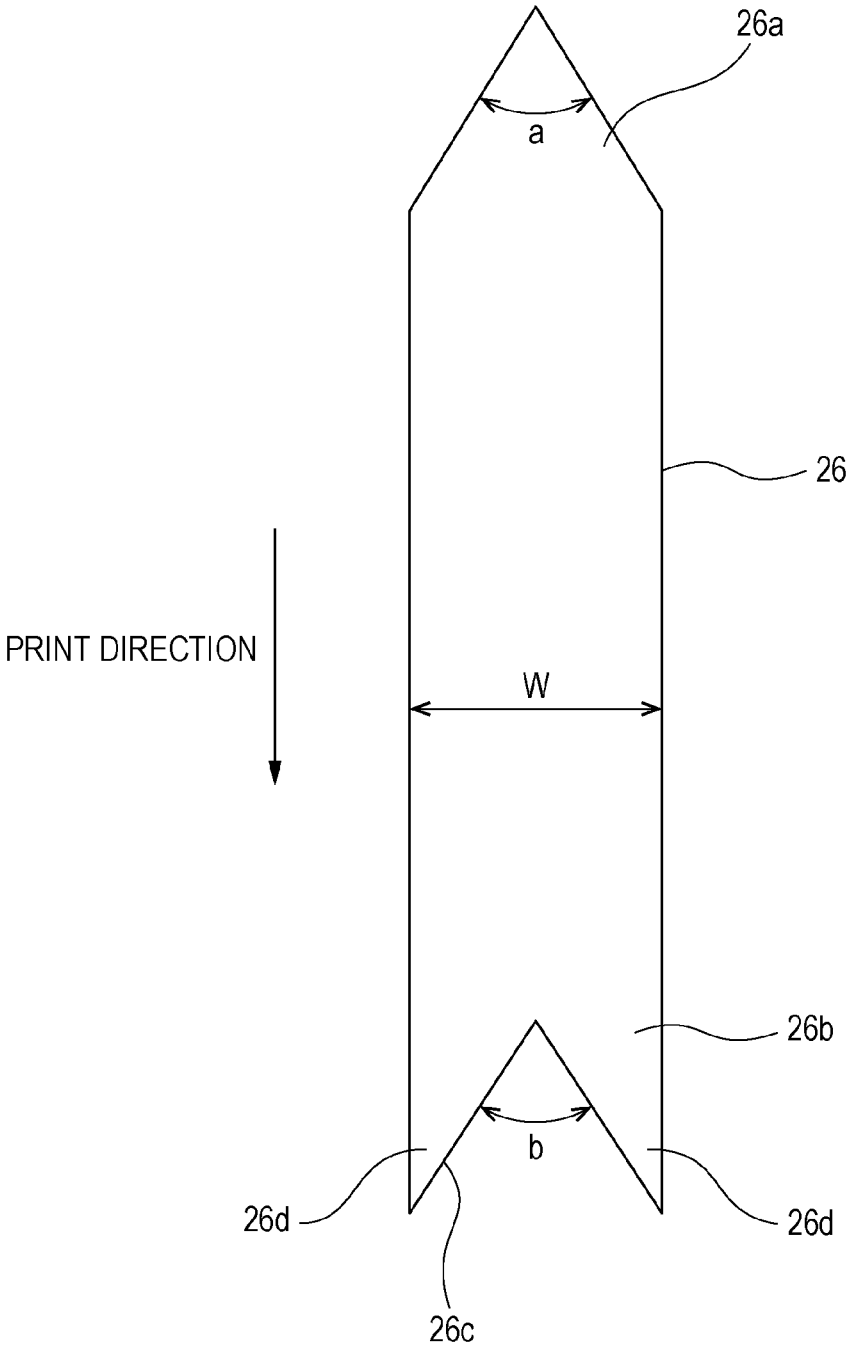
FIG. 7 is a plan view showing an electrode region portion of the gravure plate used by the gravure offset printing apparatus shown in FIG. 1.

The electrode region portions 26 of the gravure plate 11 used by the gravure offset printing apparatus 1 will now be described in greater detail. As shown in FIG. 7, each electrode region portion 26 is a region having a width w of 100 to 700 μm in a direction (i.e., the TD) perpendicular to the print direction (i.e., the MD) and a depth of 5 to 20 μm. The leading end (the end where printing starts) 26*a* of the electrode region portion 26 in the print direction is tapered (decreases in width gradually) forward in the print direction. The trailing end (the end where printing ends) 26*b* of the electrode region portion 26 in the print direction is split into a pair of branches 26*d* by a notch 26*c* tapered forward in the print direction, each branch 26*d* being tapered backward in the print direction. As used herein, the term "forward in the print direction" refers to the side where printing is performed earlier, and the term "backward in the print direction" refers to the side where printing is performed later.

As described above, in the gravure offset printing apparatus 1, the gravure offset printing method executed by the apparatus 1, and the gravure plate 11 used by the apparatus 1, the leading end 26*a* of each electrode region portion 26 is tapered forward in the print direction. Thus, when the blanket 6 is brought into contact with the gravure plate 11 in the off step, the blanket 6 can readily expel bubbles present on the gravure plate 11 (bubbles present in the printing paste P) at the leading end 26*a* thereof. This prevents pinhole defects in the print lines formed on the blanket 6. In addition, the trailing end 26*b* of the electrode region portion 26 is split into the pair of branches 26*d* by the notch 26*c* tapered forward in the print direction, each branch 26*d* being tapered backward in the print direction. Thus, when the blanket 6 is brought into contact with the gravure plate 11 in the off step, the blanket 6 can readily expel bubbles present on the gravure plate 11 (bubbles present in the printing paste P) at the trailing end 26*b* thereof. This prevents pinhole defects in the print lines formed on the blanket 6. Thus, the gravure offset printing apparatus 1, the gravure offset printing method executed by the apparatus 1, and the gravure plate 11 used by the apparatus 1 allow a fine wiring pattern, such as the bezel pattern 13, to be accurately printed on the substrate 12 while preventing pinhole defects in the fine wiring pattern. The gravure offset printing apparatus 1, the gravure offset printing method executed by the apparatus 1, and the gravure plate 11 used by the apparatus 1 are particularly effective if the grooves 21 include regions, such as the electrode region portions 26, having a width of 100 to 700 μm in a direction perpendicular to the print direction, where bubbles tend to remain in the printing paste P. The electrode region portions 26 preferably have a depth of 5 to 20 μm, more preferably 8 to 12 μm, so that the blanket 6 can readily expel the bubbles present on the gravure plate 11.

Figure 8:
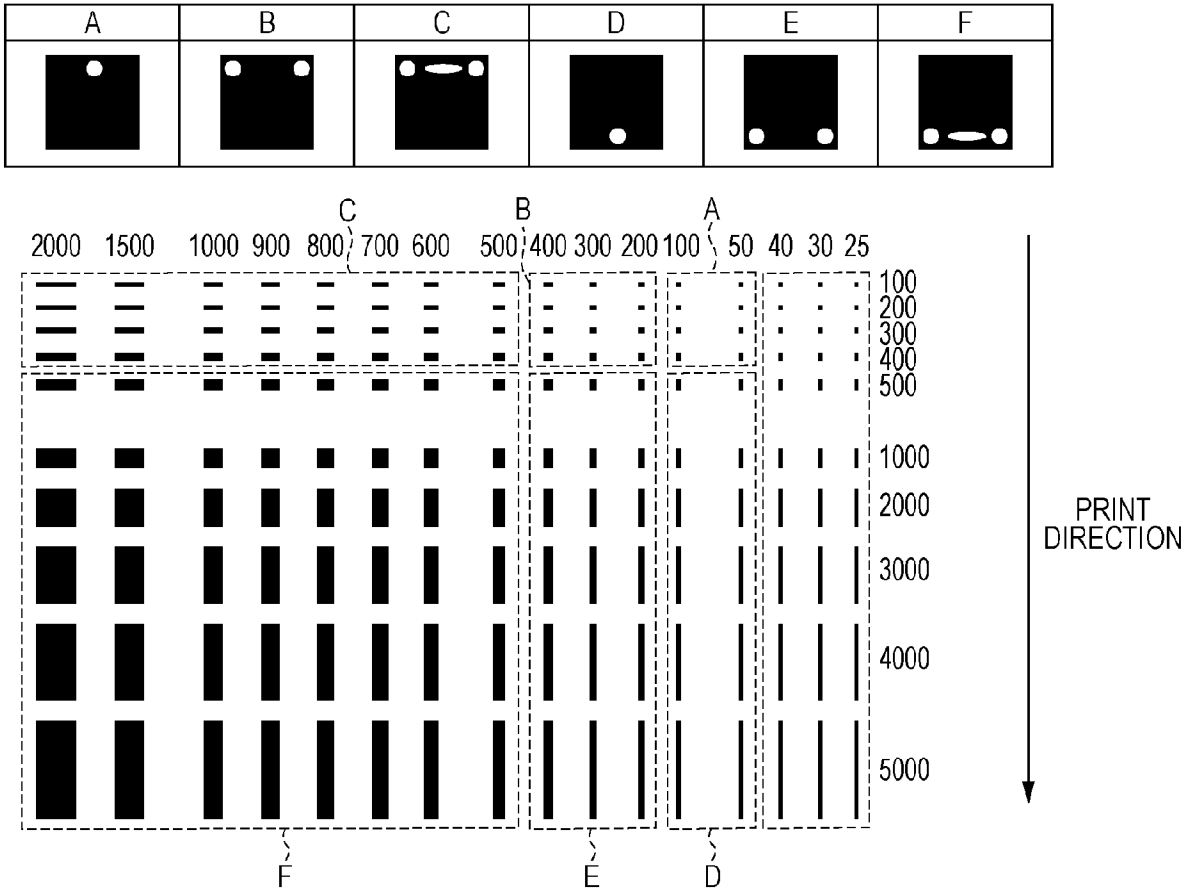
FIG. 8 shows the relationship between the width and length of electrode region portions and possible patterns of pinhole defects.

Next, a test for demonstrating the advantageous effects of the present invention will be described. An experiment was first performed to determine the relationship between the width and length of the electrode region portions and possible patterns of pinhole defects. As shown in FIG. 8, a glass intaglio plate was prepared that had electrode region portions with lengths of 100 to 5,000 μm and widths of 25 to 2,000 μm (black regions in the lower part of FIG. 8). With this intaglio plate, gravure offset printing was performed to form a conductive pattern in the following manner. Specifically, the glass intaglio plate was filled with a conductive ink composition using a doctor blade. The intaglio plate was then brought into contact with and pressed against a cylinder wrapped with a blanket to offset the desired pattern to the blanket. The coating on the blanket was then pressed against and transferred to a transparent conductive film serving as a substrate to form conductive pattern.

Examination of the resulting conductive pattern under a microscope revealed that patterns A to F of pinhole defects (white regions) shown in the upper part of FIG. 8 appeared as shown in the lower part of FIG. 8. These results show that an electrode region portion having a length of 400 μm or less tends to cause pinhole defects at the leading end in the print direction (patterns A to C) and that an electrode region portion having a length of 500 μm or more tends to cause pinhole defects at the trailing end in the print direction (patterns D to F). The results also show that an electrode region portion having a larger width tends to cause pinhole defects over a wider area, e.g., one pinhole defect in the center (patterns A and D), one pinhole defect at each corner (patterns B and E), or a plurality of pinhole defects at the corners and in the center (patterns C and F). The electrode region portions having widths of 40 μm or less caused no pinhole defect.

Figure 9:
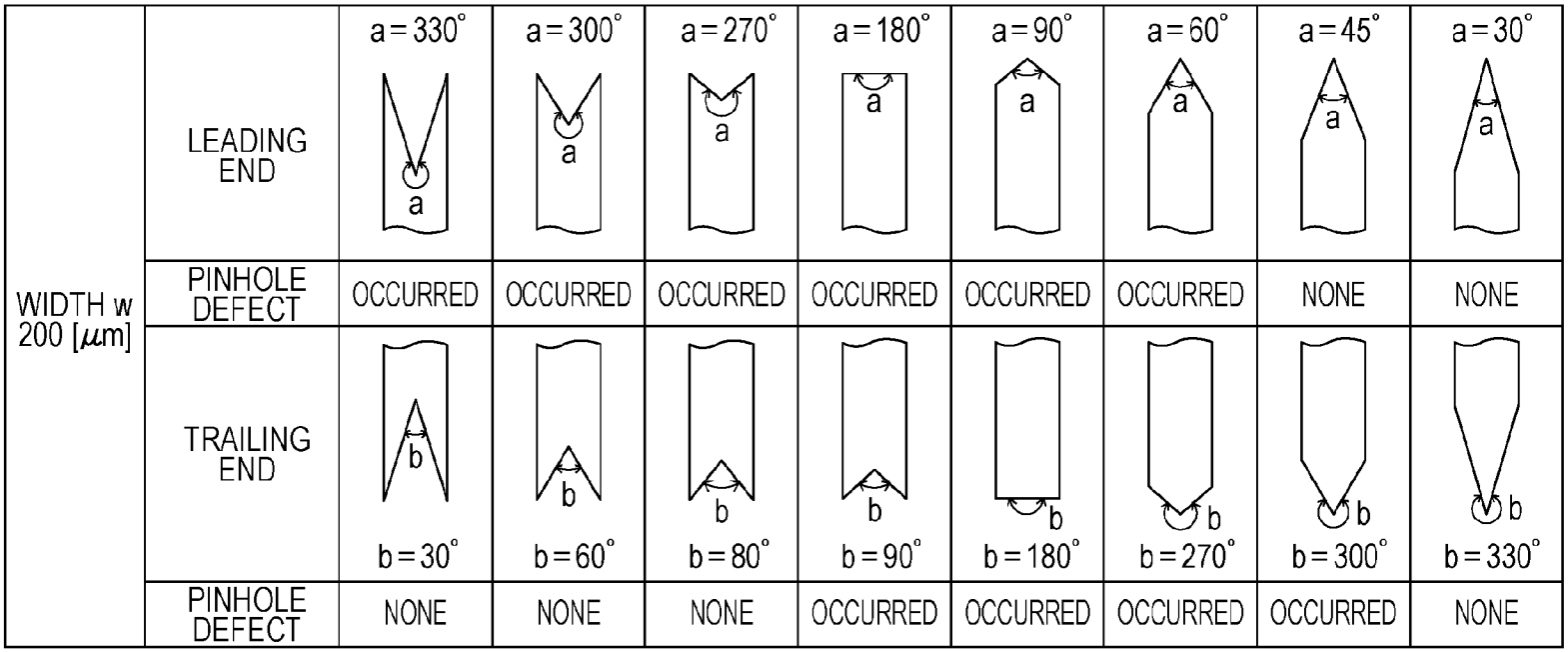
FIG. 9 shows the relationship between the shapes of the leading and trailing ends of electrode region portions having a width of 200 μm and the occurrence of pinhole defects.

The same experiment as above was then performed on electrode region portions having a width of 200 μm with varying angles a° between the two sides defining the shape of the leading end and varying angles b° between the two sides defining the shape of the trailing end. As a result, as shown in FIG. 9, no pinhole defect occurred at the leading ends of the electrode region portions at a=30° and a=45°, whereas pinhole defects occurred at the leading ends of the electrode region portions at a=60°, a=90°, a=180°, a=270°, a=300°, and a=330°. The pinhole defects that occurred at the leading end tended to have a lower frequency and a smaller area at a<180° than at a≥180°. No pinhole defect occurred at the trailing ends of the electrode region portions at b=30°, b=60°, b=80°, and b=330°, whereas pinhole defects occurred at the trailing ends of the electrode region portions at b=90°, b=180°, b=270°, and b=300°. The pinhole defects that occurred at the trailing end tended to have a lower frequency and a smaller area at b<180° than at b≥180°.

The same experiment as above was then performed on electrode region portions having a width of 600 μm with varying angles a° between the two sides defining the shape of the leading end and varying angles b° between the two sides defining the shape of the trailing end. As a result, as shown in FIG. 10, no pinhole defect occurred at the leading ends of the electrode region portions at a=120° and a=80°, whereas pinhole defects occurred at the leading ends of the electrode region portions at a=150°, a=180°, a=210°, a=240°, and a=270°. The pinhole defects that occurred at the leading end tended to have a lower frequency and a smaller area at a<180° than at a≥180°. No pinhole defect occurred at the trailing end of the electrode region portion at b=80°, whereas pinhole defects occurred at the trailing ends of the electrode region portions at b=90°, b=120°, b=150°, b=180°, b=210°, b=240°, and b=270°. The pinhole defects that occurred at the trailing end tended to have a lower frequency and a smaller area at b<180° than at b≥180°.

The same experiment as above was then performed on electrode region portions having a width of 300 μm with varying angles a° between the two sides defining the shape of the leading end and varying angles b° between the two sides defining the shape of the trailing end. As a result, no pinhole defect occurred at the leading ends of the electrode region portions at a=45° and a=60°, whereas pinhole defects occurred at the leading ends of the electrode region portions at a=80°, a=90°, and a=105°. The pinhole defects that occurred at the leading end tended to have a lower frequency and a smaller area at a<180° than at a≥180°. No pinhole defect occurred at the trailing ends of the electrode region portions at b=45°, b=70°, and b=80°, whereas pinhole defects occurred at the trailing end of the electrode region portion at b=90°. The pinhole defects that occurred at the trailing end tended to have a lower frequency and a smaller area at b<180° than at b≥180°.

The same experiment as above was then performed on electrode region portions having a width of 400 μm with varying angles a° between the two sides defining the shape of the leading end and varying angles b° between the two sides defining the shape of the trailing end. As a result, no pinhole defect occurred at the leading ends of the electrode region portions at a=45°, a=60°, a=80°, and a=90°, whereas pinhole defects occurred at the leading end of the electrode region portion at a=105°. The pinhole defects that occurred at the leading end tended to have a lower frequency and a smaller area at a<180° than at a≥180°. No pinhole defect occurred at the trailing ends of the electrode region portions at b=45°, b=70°, b=80°, and b=330°, whereas pinhole defects occurred at the trailing end of the electrode region portion at b=90°. The pinhole defects that occurred at the trailing end tended to have a lower frequency and a smaller area at b<180° than at b≥180°.

The results of the occurrence of pinhole defects at a<180° and b<180° are summarized in Tables 1 and 2.

TABLE 1

| | | Angle a at leading end [°] | | | | | | |
|---|---|---|---|---|---|---|---|---|
| | | 120 | 105 | 90 | 80 | 60 | 45 | 30 |
| Width w [μm] | 200 | | | Occurred | | Occurred | None | None |
| | 300 | | Occurred | Occurred | Occurred | None | None | |
| | 400 | | Occurred | None | None | None | None | |
| | 600 | None | | | None | | | |

TABLE 2

| | | Angle b at trailing end [°] | | | | | | |
|---|---|---|---|---|---|---|---|---|
| | | 30 | 45 | 60 | 70 | 80 | 90 | 120 |
| Width w [μm] | 200 | None | | None | | None | Occurred | |
| | 300 | | None | | None | None | Occurred | |
| | 400 | | None | | None | None | Occurred | |
| | 600 | | | | | None | Occurred | Occurred |

Figure 11:
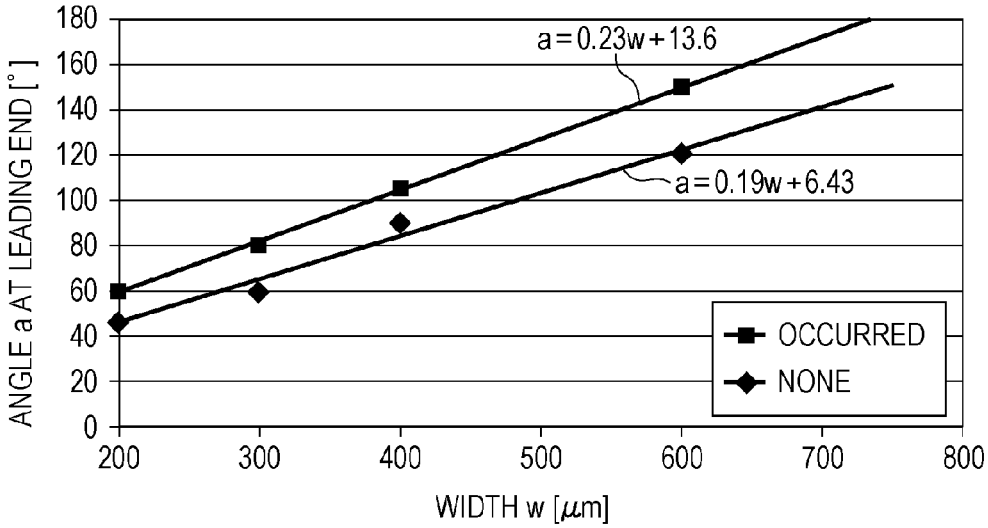
FIG. 11 is a graph showing the relationship between the width of the electrode region portions and the angle a at the leading ends of the electrode region portions.

FIG. 11 plots the results in Table 1 in a coordinate system in which the horizontal axis indicates the width w (μm) of the electrode region portions and the vertical axis indicates the angle a (°) at the leading ends of the electrode region portions. As can be seen from the graph in FIG. 11, it is preferred to satisfy the relational expression a<0.23w+13.6, where a (°) is the angle between the two sides defining the shape of the leading ends 26*a* of the electrode region portions 26, and w (μm) is the width of the electrode region portions 26 (see FIG. 7). If this relational expression is satisfied, the blanket 6 can more readily expel bubbles present on the gravure plate 11 at the leading ends 26*a* of the electrode region portions 26. This more reliably prevents pinhole defects in a fine wiring pattern.

As can be seen from the results in Table 2, it is also preferred to satisfy the relational expression b<90, where b (°) is the angle between the two sides defining the shape of the notches 26*c* in the trailing ends 26*b* of the electrode region portions 26 (see FIG. 7). If this relational expression is satisfied, the blanket 6 can more readily expel bubbles present on the gravure plate 11 at the trailing ends of the electrode region portions 26. This more reliably prevents pinhole defects in a fine wiring pattern. The electrode region portions 26 preferably have a depth of 5 to 20 μm, more preferably 8 to 12 μm, so that the blanket 6 can readily expel the bubbles present on the gravure plate 11.

Whereas an embodiment of the present invention has been described above, the present invention should not be construed as limited to the foregoing embodiment. For example, the fine wiring pattern is not necessarily applied to touch panels, but can be applied to the formation of conductive circuits, electrodes, and insulating layers in electronic components such as electronic paper and solar cells. The gravure plate is not necessarily a flat plate, but may instead be a plate cylinder. If the material to be printed is an elongated film, it may be moved and pressed against the blanket by an impression cylinder, rather than by a platen, such as the second stage 3. That is, although the foregoing embodiment illustrates a sheet-fed system using a flat gravure plate and a flat substrate, the present invention may be practiced using a gravure roll instead of a flat gravure plate or using an elongated sheet substrate instead of a flat substrate. For reasons of productivity, it is preferred to use a continuous system using a gravure roll and a flat substrate or elongated sheet substrate.

INDUSTRIAL APPLICABILITY

A gravure plate according to the present invention allows a fine wiring pattern to be accurately printed on the material to be printed while preventing pinhole defects in the fine wiring pattern. This gravure plate can be used for various gravure offset printing methods to form, for example, conductive circuits, electrodes, and insulating layers in electronic components such as touch panels, electronic paper, and solar cells.

REFERENCE SIGNS LIST

1 gravure offset printing apparatus
2 first stage (first moving mechanism)
3 second stage (second moving mechanism)
4 transport unit (first moving mechanism and second moving mechanism)
6 blanket
11 gravure plate
12 substrate (material to be printed)
13 bezel pattern (fine wiring pattern)
21 groove
26 electrode region portion
26*a* leading end
26*b* trailing end
26*c* notch
26*d* branch
P printing paste

The invention claimed is:

1. A gravure offset printing method for printing a fine wiring pattern on a material to be printed, the method comprising:

a filling step of filling a groove defined on a gravure plate such that the groove corresponds to the fine wiring pattern with a printing paste;

after the filling step, an offset step of bringing a blanket into contact with the gravure plate to offset the printing paste from the groove to the blanket; and after the offset step, a transfer step of bringing the blanket into contact with the material to be printed to transfer the printing paste from the blanket to the material to be printed, wherein the groove comprises a region having a width of 100 to 700 μm in a direction perpendicular to a print direction, the region has in the print direction a leading end tapered forward in the print direction, and the region has in the print direction a trailing end split into a pair of branches by a notch tapered forward in the print direction, each branch being tapered backward in the print direction, wherein the relational expression $a < 0.23w + 13.6$ is satisfied, where a (°) is the angle between two sides defining the shape of the leading end, and w (μm) is the width of the region, and the relational expression $b < 90$ is satisfied, where b (°) is the angle between two sides defining the shape of the notch.

2. A gravure offset printing apparatus for printing a fine wiring pattern on a material to be printed, the apparatus comprising:

a blanket configured to be brought into contact with a gravure plate having a groove defined thereon such that the groove corresponds to the fine wiring pattern to offset a printing paste from the groove to the blanket and to be brought into contact with the material to be printed to transfer the printing paste from the blanket to the material to be printed;

a first moving mechanism configured to move the gravure plate while maintaining the blanket in contact with the gravure plate; and a second moving mechanism configured to move the material to be printed while maintaining the blanket in contact with the material to be printed, wherein the groove comprises a region having a width of 100 to 700 μm in a direction perpendicular to a print direction, the region has in the print direction a leading end tapered forward in the print direction, and the region has in the print direction a trailing end split into a pair of branches by a notch tapered forward in the print direction, each branch being tapered backward in the print direction, wherein the relational expression $a < 0.23w + 13.6$ is satisfied, where a (°) is the angle between two sides defining the shape of the leading end, and w (μm) is the width of the region, and the relational expression $b < 90$ is satisfied, where b (°) is the angle between two sides defining the shape of the notch.

3. A gravure plate for use in a gravure offset printing apparatus for printing a fine wiring pattern on a material to be printed, the gravure plate having a groove defined thereon such that the groove corresponds to the fine wiring pattern, wherein the groove comprises a region having a width of 100 to 700 μm in a direction perpendicular to a print direction, the region has in the print direction a leading end tapered forward in the print direction, and the region has in the print direction a trailing end split into a pair of branches by a notch tapered forward in the print direction, each branch being tapered backward in the print direction, wherein the relational expression $a < 0.23w + 13.6$ is satisfied, where a (°) is the angle between two sides defining the shape of the leading end, and w (μm) is the width of the region, and the relational expression $b < 90$ is satisfied, where b (°) is the angle between two sides defining the shape of the notch.

* * * * *